United States Patent [19]

Ming

[11] Patent Number: 4,514,730

[45] Date of Patent: Apr. 30, 1985

[54] PIPELINE MONITORING APPARATUS

[75] Inventor: Paul T. Ming, Middlesbrough, England

[73] Assignee: Imperial Chemical Industries PLC, Hertfordshire, England

[21] Appl. No.: 451,594

[22] Filed: Dec. 20, 1982

[30] Foreign Application Priority Data

Dec. 23, 1981 [GB] United Kingdom ..... 8138834

[51] Int. Cl.[3] ..... G08B 5/24

[52] U.S. Cl. ..... 340/815.26; 340/815.1; 422/53

[58] Field of Search ..... 340/815.1, 815.26; 422/53, 58

[56] References Cited

U.S. PATENT DOCUMENTS 3,210,758 10/1965 Huston ..... 340/815.26

*Primary Examiner*—Stephen A. Kreitman
*Assistant Examiner*—Tom Noland
*Attorney, Agent, or Firm*—Cushman, Darby & Cushman

[57] ABSTRACT

An apparatus is described for providing a visual display of the presence or absence of a change from the normal to the abnormal in the condition of a pipeline, for example an adverse change in the current supply to the pipeline for cathodic corrosion control purposes. In a preferred form, the apparatus consists of a transparent weatherproof housing within which is mounted two sets of vanes, one set being immovable and the other set being mounted on a rotatable central shaft which is linked to the instrument monitoring the condition of the pipeline. The vanes are painted in distinctive colors so that in the normal position, a single color or distinctive pattern can be seen by a distant observer as an indication that all is well. Upon an adverse change in condition, the central shaft is rotated so as to move the movable vanes to another position where a different color or color pattern is displayed, thus indicating the occurrence of the adverse change to the distant observer.

7 Claims, 4 Drawing Figures

PIPELINE MONITORING APPARATUS

The present invention relates to an apparatus and method for monitoring the condition of an underground pipeline.

Pipelines are now widely used to carry various gases, liquids and solids from one location to another and in some countries networks of interlinked pipelines, some of which are well over 100 miles in length, have been developed. For much of their length pipelines are laid underground and so it is essential that they are made of durable materials which are neither prone to fracture nor likely to erode or corrode, for example various steel alloys. Nevertheless, certain wear and tear is inevitable but, so far as is possible, unnecessary wear is avoided.

Pipelines are usually laid through open country for the most part, away from human habitation. For much of their length, except where they cross roads or railways, pipelines are likely to be accessible only with some difficulty and sometimes with great difficulty. Nevertheless for safe and efficient operation, pipelines and their condition must be monitored and inspected at regular intervals for faults of various kinds including leaks and other potentially threatening conditions. Since much of the length of a pipeline may be located in isolated terrain, inspection of the line by foot, or even using specialised tracked vehicles, can be an arduous excercise. In recent years, helicopters have been used more and more to carry out inspections but even then difficulties may arise. If a fault or a possible fault in the line is detected from the air, the inspector may wish to take a closer look at the location from the ground, especially in cases where the existence of a fault is in doubt but the helicopter may only be able to land at some distance from the line so that he may still be faced with a difficult walk on foot to reach the pipeline.

Corrosion of the pipeline is clearly one of the threatening conditions which must be guarded against and for which the pipeline must be inspected or monitored. If follows, therefore, that protection of the pipeline against corrosion is one of the steps frequently taken to maintain it in good condition. Some protection can be obtained by physical methods, for example by wrapping the pipeline in a bituminous wrap, but other methods may also be used. As is well-known, corrosion is an electrochemical process in which the corroding metal surface may be visualised as composed of a large number of local anode sites and a large number of local cathode sites. Cathodic control methods are often used to counter corrosion by applying a small cathodic current to the metal so as to move the potential of the metal below the potential of the reversible or equilibrium potential of the corroding reaction, thereby inhibiting corrosion. The cathodic current can be applied by an external source, such as a rectifier or by a sacrificial anode.

Although cathodic control of corrosion can be very effective, some difficulties can arise in its application to a pipeline because of the usually remote location of the pipeline. Cathodic control requries that a supply of electric current be applied to a pipeline at regular intervals along its length and that the supply of current be maintained at all times above a certain voltage. In general, it is possible to guarantee to a very large degree that the supply of current for cathodic control at the various points along the pipeline will be reliable and will remain so for several years. Unfortunately, the guarantee is not absolute and faults do occur from time to time which may lead to the current supply at one or more points falling below the minimum necessary to maintain cathodic control of corrosion. Like leaks (which may arise of course because of corrosion), failure of corrosion control provisions is one of the pipeline conditions which must be monitored throughout the length of the pipeline, however inaccessible it may be.

We have now devised an apparatus which is a visual indicator responding to adverse changes in the condition of a pipeline, for example adverse changes in the supply of current for corrosion control, and which can be adapted to provide a display visible from some distance away reflecting the normality or otherwise of the condition being monitored, for example the corrosion control current supply.

According to the present invention apparatus for displaying the presence or absence of a change from the normal to abnormal in the condition of a pipeline, for example in the current supplied to the pipeline for corrosion control purposes, comprises at least two pairs of vanes mounted around and extending outwardly from a substantially upright shaft, wherein (i) at least one pair of vane members is mounted immovably on opposite sides of said shaft, the angle between said vane members being substantially 180°, (ii) at least one other pair of vane members is mounted on said shaft, the members of each of said other pair(s) of vanes being mounted on opposite sides of said shaft and being movable relative to said immovably mounted vane members, in such a manner that, (a) in a first (normal) position the angle between an immovable vane member and an adjacent relatively movable vane member is not greater than about 15° and (b) said movable vane members are adapted to move from said first (normal) position to a second (abnormal) position so that in said second position said angle is substantially zero.

In a preferred embodiment of the apparatus, two pairs of immovably mounted vane members are provided together with two pairs of movable vane members mounted on a substantially vertical shaft, the angle between each of the immovable vane members being 90° and the angle between each of the movable vane members being substantially 90°, each movable vane member lying, in said first (normal) position, adjacent to a corresponding first fixed vane member and being adapted to move through at least about 75° so that in said second (abnormal) position it lies adjacent a second fixed vane member.

Thus, there is a movable vane member adjacent each of the four immovably mounted vane members, the movable members being so arranged in the first (normal) position as to move away from their adjacent fixed vane member so as to take up a new position in the second (abnormal) position which is adjacent another fixed vane member 90° away.

Preferably, the apparatus is mounted in a weatherproof housing having transparent walls so that the position of the vane members can be observed from a distance, if necessary with an optical aid such as binoculars. The weatherproof housing is suitably made of a material which is not only resistant to weather but which is also resistant to accidental or deliberate damage by animals or man, for example a polycarbonate material. To assist the distant observer the surfaces of all the vane members are painted in bright colours so that in the first (normal) position, one colour is apparent to the observer while in the second (abnormal) position a different colour is apparent. This is achieved by painting the front and back of each vane member in different colours so that in the normal position, the visible surfaces of the vanes all exhibit the same colour or pattern of colours and in the abnormal position the then visible surfaces exhibit a different colour or pattern of colours. Thus the distant observer, depending on what colour he sees, can ascertain from a comfortable distance (including from the air) and without having to go to the actual pipeline itself whether the particular pipeline condition being monitored, for example the corrosion control current is in the normal or abnormal mode.

The apparatus of this invention is designed so as to be linkable by suitable linkage means to an instrument or other means monitoring the condition of the pipeline so that if the instrument or other means detects an undesirable change in that condition, the said linkage means is activated so as to cause the shaft on which the movable vane members are mounted to rotate sufficiently to carry the movable vane members from their first (normal) position to the second (abnormal) position. In a preferred embodiment in which the corrosion control current is the feature being monitored, a voltage-responsive solenoid is linked between the current supply and the shaft carrying the movable vane members in such a way that if the voltage of the electric supply remains above a predetermined level then the vane members are held in the first (normal) position. If, however, the voltage-responsive relay operating the solenoid detects a fall in voltage below the predetermined level it actuates the link to the shaft so as to rotate it and move the vane members to the second (abnormal) position.

A preferred embodiment of the apparatus of this invention is hereinafter further described in more detail with reference to the accompanying drawings in which FIG. 1 is a plan view, partly in section, of the apparatus in the first (normal) position;

Figure 1:
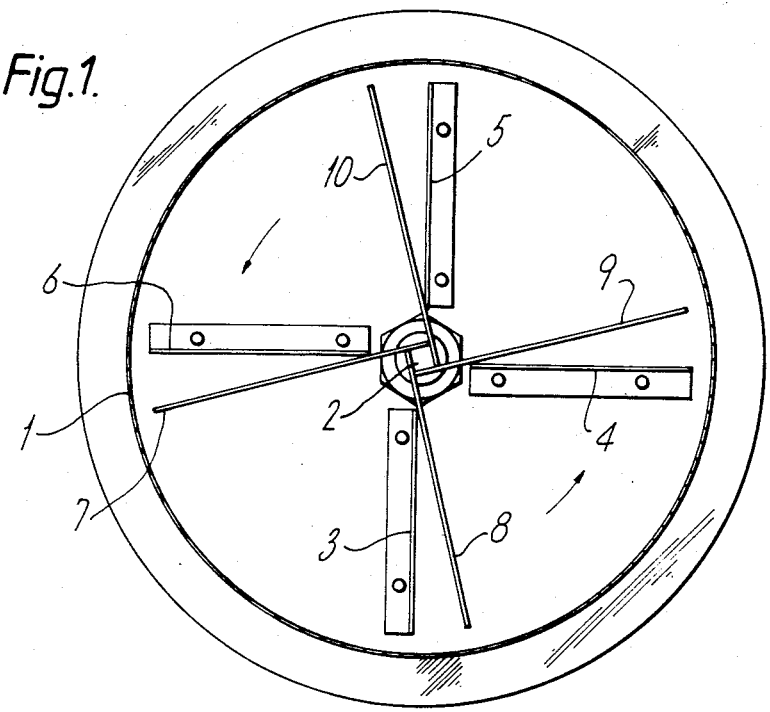
Figure 2:
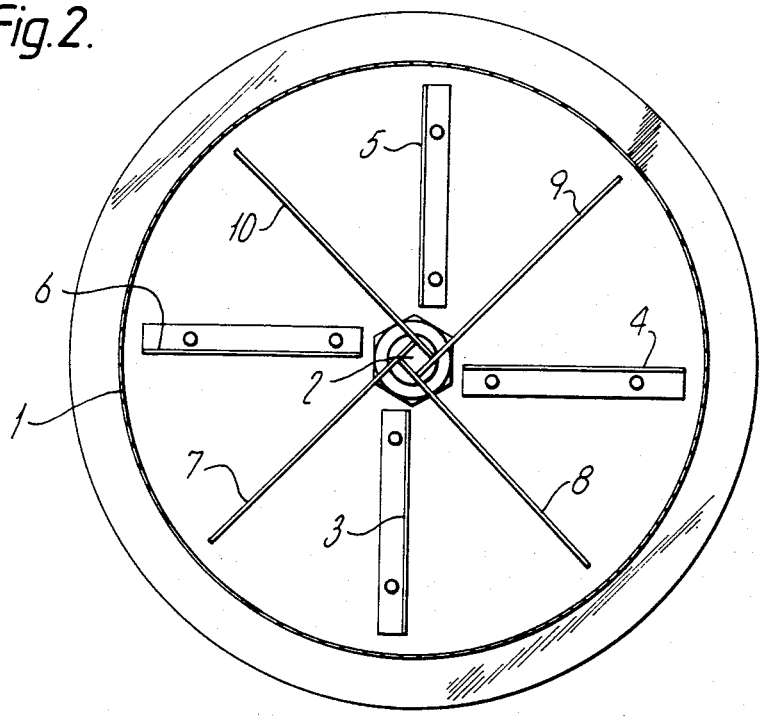
FIG. 2, is a similar plan view but of the apparatus in a position between the first (normal) and second (abnormal) positions.

Referring to the drawings, the apparatus comprises a transparent housing 1 made of polycarbonate and having a central spindle 2. Four vanes, 3, 4, 5 and 6 made of Duralumin are fixed immovably to a casing 13 (see FIG. 3) at 90° to each other and a further four vanes, 7, 8, 9 and 10 are mounted on the spindle in such a way that they can move from the positions shown in FIG. 1 in the direction of the arrows.

Figure 3:
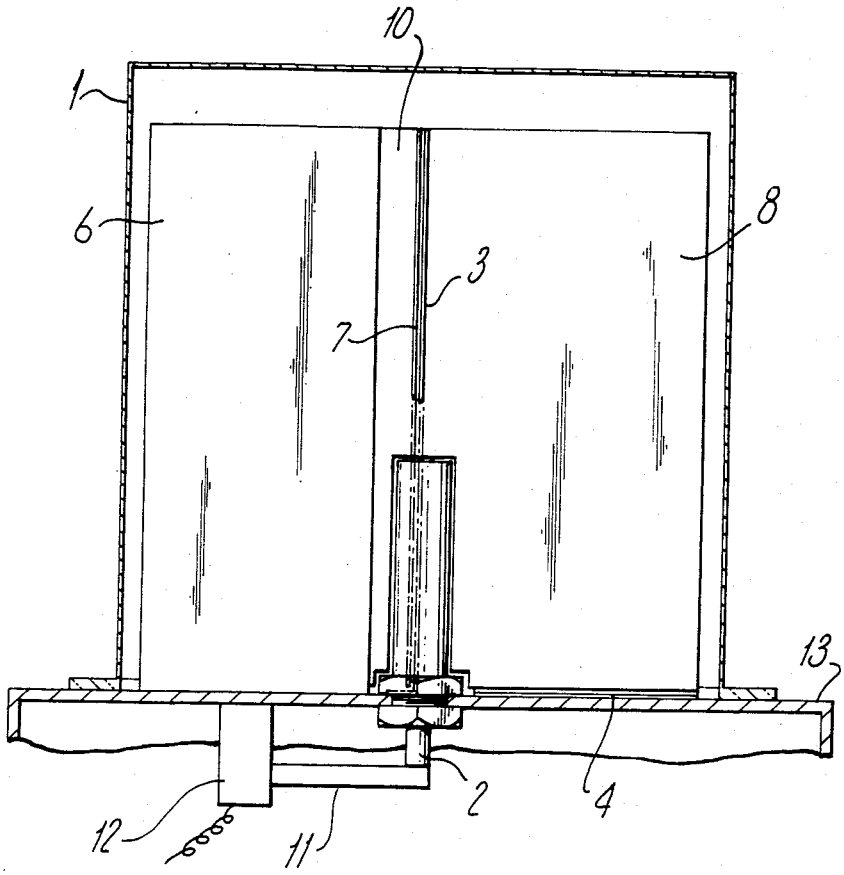
FIG. 3 is a front elevation, partly in section of the apparatus in the second (abnormal) position.

Referring to FIG. 3, the spindle 2 extends out of the bottom of the casing 13 and is connected, through a linkage system 11, to a solenoid 12 which forms part of the supply system which provides electric current for cathodic corrosion control of an associated pipeline (not shown). The linkage system 11 and solenoid 12 are housed within a container formed by casing 13. For clarity, the details of this current supply system, which will be familiar to those skilled in this art, are not shown.

In operation, current at a pre-determined suitable voltage is supplied through the supply system (which may include a transformer and rectifier unit) including solenoid 12 for cathodic corrosion control of an associated pipeline. The vanes of the apparatus are in the position shown in FIG. 1, all the visible vane surfaces being coloured a suitably bright colour, say red. Thus, viewed from a distance, the sight of red colouring in the housing will indicate that conditions are normal.

Figure 4:
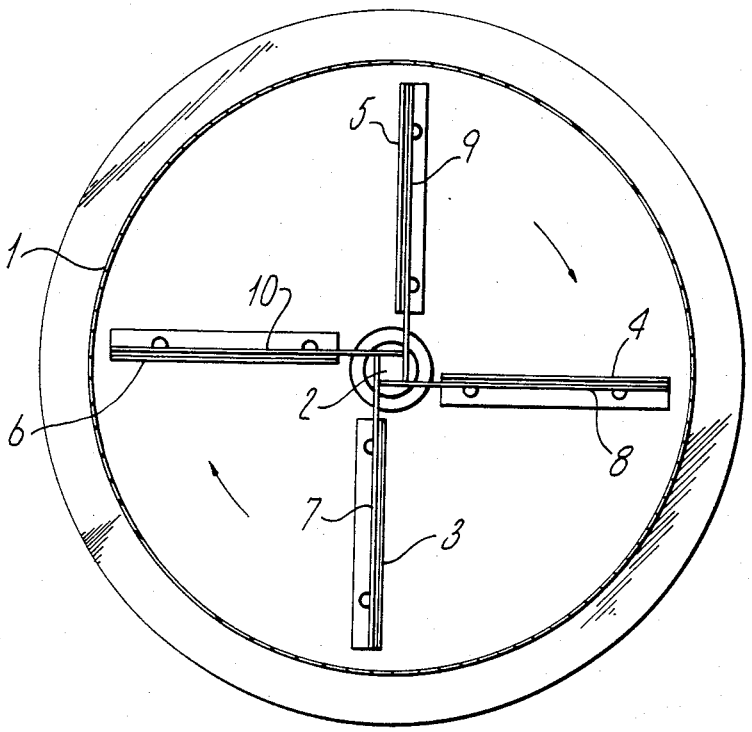
FIG. 4 is a plan view of the apparatus in the abnormal position.

If the voltage of the electricity supply falls below a certain pre-determined level which would mean that cathodic corrosion control would no longer be adequate, the voltage-sensitive relay will de-energise solenoid 12 thereby releasing spindle 2 carrying the movable vanes so that they are moved through about 90° with the aid of a spring, thus allowing the other, hitherto hidden, faces of the vanes to appear. (FIG. 4 illustrates the positions of the vanes after this movement has occurred.) These other faces are also painted a distinctive, different colour, say black, indicating that abnormal conditions prevail.

Although the apparatus of this invention is described herein with particular reference to its application in monitoring cathodic corrosion control, those skilled in this art will realise that it is readily applicable to monitoring other features of pipeline operations where a change from normal to abnormal conditions can be used to induce corresponding movement of the movable vanes of the apparatus, for example by causing the change in conditions to trip a relay linked to the vanes. The features monitored can include not only those concerned with conditions in and around the pipeline itself but also conditions in plant and equipment associated with the pipeline, for example compressor and pumping stations located along the length of the pipeline.

I claim:

1. Apparatus for displaying the presence or absence of a change from the normal to abnormal in the condition of a pipeline comprising at least two pairs of vanes mounted around and extending outwardly from a substantially upright shaft, wherein (i) at least one pair of vane members is mounted immovably on opposite sides of said shaft, the angle between said vane members being substantially 180°, (ii) at least one other pair of vane members is mounted on said shaft, the members of each of said other pair(s) of vanes being mounted on opposite sides of said shaft and being movable relative to said immovably mounted vane members, in such a manner that, (a) in a first (normal) position the angle between an immovable vane member and an adjacent relatively movable vane member is not greater than about 15° and (b) said movable vane members are adapted to move from said first (normal) position to a second (abnormal) position so that in said second position said angle is substantially zero.

2. Apparatus as claimed in claim 1 wherein two pairs of immovably mounted vane members are provided together with two pairs of movable vane members on a substantially vertical shaft, the angle between each of the immovable vane members being 90° and the angle between each of the movable vane members being substantially 90°, each movable vane member lying, in said first (normal) position, adjacent to a corresponding first fixed vane member and being adapted to move through at least about 75° so that in said second (abnormal) position it lies adjacent a second fixed vane member.

3. Apparatus as claimed in claim 1 wherein the apparatus is mounted in a weatherproof housing having transparent walls.

4. Apparatus as claimed in claim 3 wherein the weatherproof housing is made of a polycarbonate material.

5. Apparatus for displaying the presence or absence of a change from the normal to abnormal in the condition of a pipeline comprising at least two pairs of vanes mounted around and extending outwardly from a substantially upright shaft, wherein (i) at least one pair of vane members is mounted immovably on opposite sides of said shaft, the angle between said vane members being substantially 180°, (ii) at least one other pair of vane members is mounted on said shaft, the members of each of said other pair(s) of vanes being mounted on opposite sides of said shaft and being movable relative to said immovably mounted vane members, in such a manner that, (a) in a first (normal) position the angle between an immovable vane member and an adjacent relatively movable vane member is not greater than about 15°, (b) said movable vane members are adapted to move from said first (normal) position to a second (abnormal) position so that in said second position said angle is substantially zero, and (iii) there is means for monitoring the pipeline and a linkage linking the monitoring means to the apparatus in such a manner that when ever an undesirable change in said condition is detected said linkage is activated so as to cause said shaft on which said movable vanes are mounted to rotate sufficiently to carry the movable members from their first position to their second position, said monitoring means being adapted to monitor corrosion current supply to the pipeline and said linkage including a voltage-responsive solenoid linked between a current supply and said shaft.

6. Apparatus for displaying to a distant viewer the presence or absence of a change in the condition of a pipeline, comprising: a rotatable shaft carrying at least one pair of radially extending vanes having front and rear surfaces which face generally transversely to the axis of the shaft; and at least one pair of radially extending fixed vanes alternating with the shaft-mounted vanes and having front and rear surfaces which face generally transversely to the axis of the shaft, the shaft being rotatable between first and second positions and the arrangement being such that in said first position shaft-mounted vane is adjacent to and overlies a fixed vane so that essentially all of one surface of a fixed vane and essentially all of one surface of a shaft-mounted vane are visible along a given sight line which is transverse to the axis of the shaft, said one surfaces having a common visual appearance, and in said second position each shaft-mounted vane is adjacent to and overlies another fixed vane so that, along said given sight line, different vane surfaces are visible along said sight line, said different surfaces having a common visual appearance which is different from the appearance of said one surfaces.

7. Apparatus as in claim 6 including monitoring and control means responsive to the presence or absence of a condition of the pipeline for rotating said shaft from one of its positions to the other.

* * * * *